US007065305B2

(12) United States Patent
Oyaide

(10) Patent No.: US 7,065,305 B2
(45) Date of Patent: Jun. 20, 2006

(54) TONER SUPPLYING METHOD FOR IMAGE FORMING APPARATUS

(75) Inventor: Masaaki Oyaide, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 154 days.

(21) Appl. No.: 10/800,635

(22) Filed: Mar. 16, 2004

(65) Prior Publication Data

US 2005/0207764 A1 Sep. 22, 2005

(51) Int. Cl.
*G03G 15/08* (2006.01)

(52) U.S. Cl. ..... 399/27; 399/30

(58) Field of Classification Search ..... 399/27, 399/30, 61

See application file for complete search history.

(56) References Cited

U.S. PATENT DOCUMENTS 4,777,512 A * 10/1988 Takahashi et al. ..... 399/30
5,036,363 A * 7/1991 Iida et al. ..... 399/30
5,790,917 A * 8/1998 Takura et al. ..... 399/27
6,438,330 B1 8/2002 Itoh
6,628,904 B1 * 9/2003 Yamada ..... 399/27
6,670,817 B1 * 12/2003 Fournier et al. ..... 324/662
6,895,192 B1 * 5/2005 Katoh et al. ..... 399/27

FOREIGN PATENT DOCUMENTS

JP 2-157776 A 6/1990
JP 7-28323 A 1/1995
JP 2002-62720 A 2/2002

* cited by examiner

*Primary Examiner*—Louis M. Arana
(74) *Attorney, Agent, or Firm*—Foley & Lardner LLP

(57) ABSTRACT

When shortage of a toner residual quantity is detected during printing, toner redetection is performed immediately after completion of printing. This toner redetection is carried out by stopping supply of a high-voltage power to, e.g., a transfer charger and supply of a power to a motor such as a paper carriage motor in order to avoid generation of noise. As a result, a toner sensor can correctly detect the toner residual quantity, and the toner can be appropriately supplied.

16 Claims, 7 Drawing Sheets

TONER SUPPLYING METHOD FOR IMAGE FORMING APPARATUS

BACKGROUND OF THE INVENTION

The present invention relates to a toner residual quantity detection method in an image forming apparatus such as a printer or a digital copying machine.

When copying an original document by using an image forming apparatus, an original image is first read by a scanner portion, and corresponding image data is provided. In a printer portion, an electrostatic latent image is formed on a photosensitive drum by using light beams emitted in accordance with the image data. A toner is caused to adhere to this electrostatic latent image by a developer, and a toner image is formed. The toner image is transferred onto a paper sheet by a transfer portion, and fixed on the paper by a fixing portion. In this manner, a copy image is printed on the paper.

During printing an image as described above, a toner residual quantity is detected in the developer. When it is determined that the toner residual quantity is insufficient, the toner is supplied from a supply toner cartridge.

If toner detection is carried out during printing, a toner sensor may erroneously operate due to affects of noise from, e.g., a development high-voltage power supply and a paper carriage motor drive system. When the toner sensor malfunctions, it may be determined that the toner residual quantity is insufficient even though the toner residual quantity is sufficient, and an unnecessary supply operation may be executed in some cases.

For example, if there is a poor contact at a contact point of a high-voltage supply path used in a development process, an induction noise may occur due to electric discharge, and the toner sensor which operates with a small voltage and a small current may malfunction.

Further, in order to reduce an influence of such noise, a special component is needed for the toner residual quantity detection circuit, and special attention must be paid to the sensor arrangement and wiring.

BRIEF SUMMARY OF THE INVENTION

It is an object of the present invention to correctly detect a toner residual quantity in a process unit of a toner sensor, and prevent the process unit from being over charged with the toner due to unnecessary toner supply.

In order to achieve the above object, according to the present invention, there is provided an image forming apparatus comprising: a latent image formation portion which forms an electrostatic latent image on a photoreceptor based on an inputted image signal; a development portion which causes a toner to adhere on the electrostatic latent image formed on the photoreceptor, to develop a toner image; a transfer portion which transfers the toner image onto a paper sheet; a carriage portion which carries the paper sheet; a residual quantity detecting portion which detects a toner residual quantity of the development portion; a first detecting portion which detects the toner residual quantity by using the residual quantity detecting portion during printing; a second detecting portion which partially stops power supply to each portion in the apparatus when the first detecting portion detects shortage of the toner residual quantity, and again detects the toner residual quantity by using the residual quantity detecting portion; and a supply portion which supplies the toner to the development portion when the second detecting portion detects the shortage of the toner residual quantity.

DETAILED DESCRIPTION OF THE INVENTION

An embodiment according to the present invention will now be described in detail hereinafter with reference to the accompanying drawings.

Figure 1:
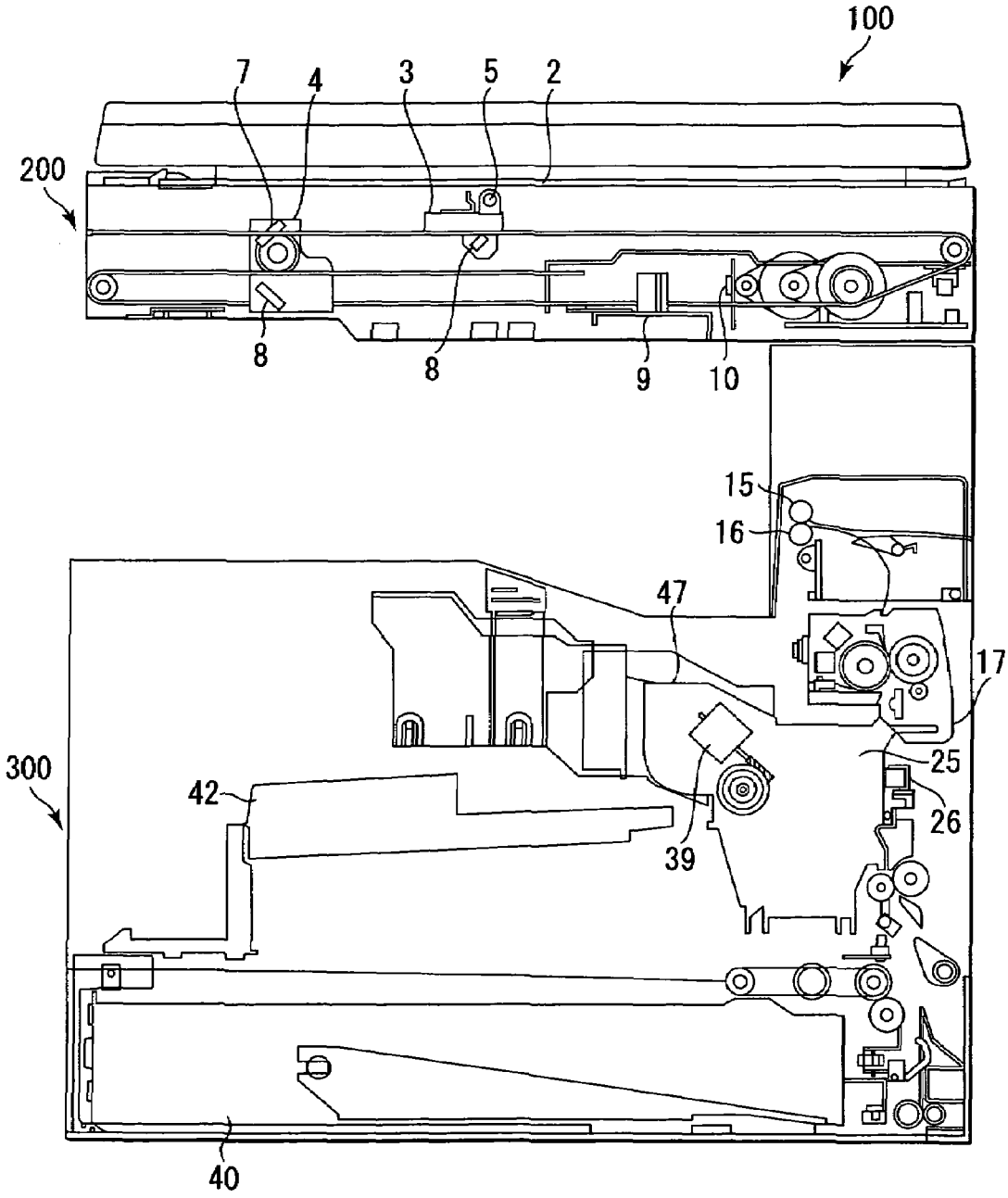
FIG. 1 is a front cross-sectional view schematically showing a structure of an image forming apparatus such as a digital copying machine to which the present invention is applied.

FIG. 1 is a front cross-sectional view schematically showing a structure of an image forming apparatus 100 such as a digital copying machine to which the present invention is applied. The image forming apparatus 100 includes a scanner portion 200 which reads an original image and provides image data corresponding to the original image, and a printer portion 300 which forms an image on a paper sheet based on the image data supplied from the scanner portion 200. A control panel (not shown) which carries out a user interface is provided to the scanner portion 200. The image forming apparatus 100 is connected to a network such as a LAN. The digital copying machine 100 operates based on a user instruction inputted through the control panel or the network.

The scanner portion 200 comprises a first carriage 3 having a light source 5 and a first mirror 6, a second carriage 4 having a second mirror 7 and a third mirror 8, a lens 9 and a CCD as a primary portion. When reading an original document, an original document placed on an original glass 2 is irradiated by the light source 5 of the first carriage 3 which moves in a sub-scanning direction. Reflected light beams from the original document are reflected on the first to third mirrors, condensed by the lens 9 and led to the CCD 10. At this time, the second carriage 4 moves in the same direction as the moving direction of the first carriage 3 at a speed which is ½ of that of the first carriage 3 in such a manner that a light path length (focal distance) of the reflected light beams from the original document to the CCD 10 becomes fixed. The CCD 10 scans the incoming reflected light beams in a main scanning direction. As a result, an image on the original document surface is converted into an electric signal.

The printer portion 300 comprises a laser scanner unit 42, a process unit 25, a fixation unit 17 as a primary portion. The laser scanner unit 42 exposes and scans a photosensitive drum circumferential surface in the process unit 25 by using laser beams generated based on image data provided from the scanner portion 200. As a result, an electrostatic latent image corresponding to the image data is formed on the photosensitive drum circumferential surface. In the process unit 25, a toner is caused to adhere on the electrostatic latent image formed on the circumferential surface of the photosensitive drum, and this toner image is transferred onto a paper sheet carried from a paper feed cassette 40 by a transfer charger 26. The toner image on the paper sheet is fixed on the paper sheet by the fixation unit 17, and the paper sheet is supplied from the apparatus by paper ejector rollers 15 and 16.

A toner residual quantity detection method according to the present invention will now be described.

In the embodiment according to the present invention, when printing images, a toner residual quantity is detected during printing, toner is not immediately supplied when shortage of the toner residual quantity is detected, but the toner residual quantity is again detected after completion of printing (that is, when a high-voltage power supply and a motor drive circuit are not operated). When the toner residual quantity is still insufficient even though the toner residual quantity is again detected, the toner is supplied. As a result, it is possible to prevent erroneous detection of a toner residual quantity detecting portion due to noise mixed in the toner residual quantity detecting portion from a high-voltage power supply path and/or a motor drive circuit.

In the case of continuous printing in which images are continuously printed on many sheets of paper, suspending printing in mid course in order to re-detect the toner residual quantity lowers the productivity of printing. Therefore, when the preset number of printing sheets is exceeded after detecting the shortage of the toner residual quantity, the toner is supplied.

Figure 2:
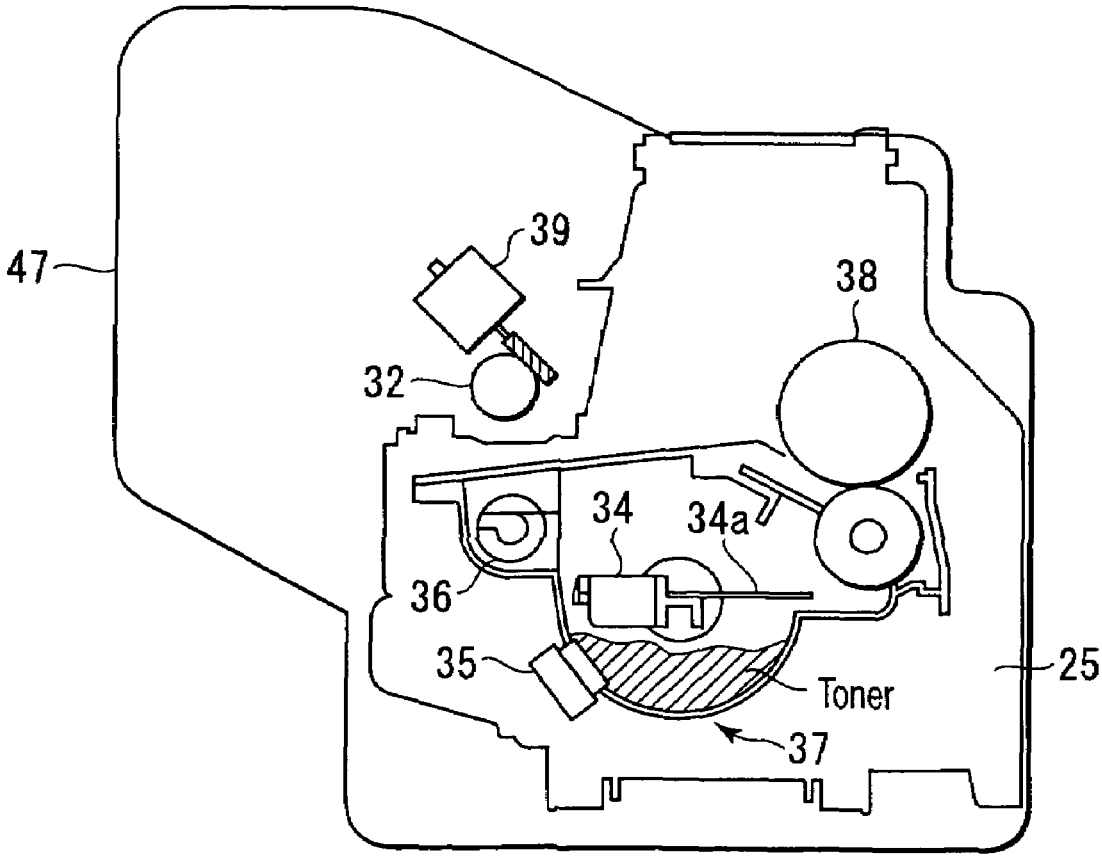
FIG. 2 is a cross-sectional view of a process unit.

FIG. 2 is a cross-sectional view of a process unit 25. A toner cartridge 47 is provided at the inner part of the process unit 25 in the drawing.

The toner cartridge 47 is coupled with the process unit 25 in a separable manner. Rotating a toner supply DC motor 39 rotates a toner cartridge auger 32, and the toner accommodated in the toner cartridge 47 falls on a substantially central part of the process unit 25. The toner which has fallen into the process unit 25 is supplied from the central part of the process unit 25 to the toner accommodation portion 37 by a toner supply auger 36 which likewise rotates.

A mixer 34 which rotates by a carriage DC motor is provided at the toner accommodation portion 37, and a rotary blade 34*a* of the mixer 34 agitates the toner and evenly distributes it in the longitudinal direction (front inner direction in the drawing) of a photosensitive drum 38. In the toner accommodation portion 37 is arranged a toner empty sensor (which will be referred to as a toner sensor hereinafter) 35 which generates high-frequency vibrations by using a piezoelectric element and detects a toner residual quantity by detecting a change in a small current.

When the toner sensor 35 detects the shortage of the toner residual quantity, the toner is supplied from the toner cartridge 47 to the process unit 25 by the above-described method.

The present invention aims at stabilizing detection of this toner sensor 35 and preventing the process unit 25 from being over charged with the toner due to unnecessary toner supply.

The toner sensor 35 vibrates a diaphragm at a high frequency by using the piezoelectric element as described above, and detects a micro signal which varies in accordance with a toner quantity on the diaphragm, thereby detecting the toner residual quantity. Since the toner sensor detects a small analog signal, it has a weak point that it readily malfunctions due to affects of electrical noise, physical vibrations and others.

A voltage from a high-voltage power supply is supplied to an electrification charger which electrifies the photosensitive drum 38, a transfer charger which transfers the toner onto a paper sheet, a paper detachment charger which detaches the paper sheet from the photosensitive drum and smoothly performs fixation/paper ejection, and others. The state of these gap portions, in which a high voltage is generated, subtly varies due to the physical vibrations involved during paper carriage, and electric discharge occurs. The detection of the toner residual quantity is thus apt to be affected by such discharge induction noises or induction noise generated by a DC motor (paper carriage motor).

Therefore, it is optimum to detect the toner in a non-printing mode in which the physical vibrations and the electrical noise are not generated. However, since the toner agitation mixer 34 is not rotated in the non-printing mode, a toner state in the toner accommodation portion 37 may not be stabilized in some cases, making stable and correct toner detection difficult.

In this embodiment, the toner is detected during printing and, if the shortage of the toner residual quantity is detected, the carriage motor and supply of the high-voltage power are stopped, and the toner is re-detected in the non-printing mode immediately after this stop. As a result, the stable toner detection is executed without being affected by noise in the printing mode and unstableness of the toner state in the non-printing mode.

Figure 3:
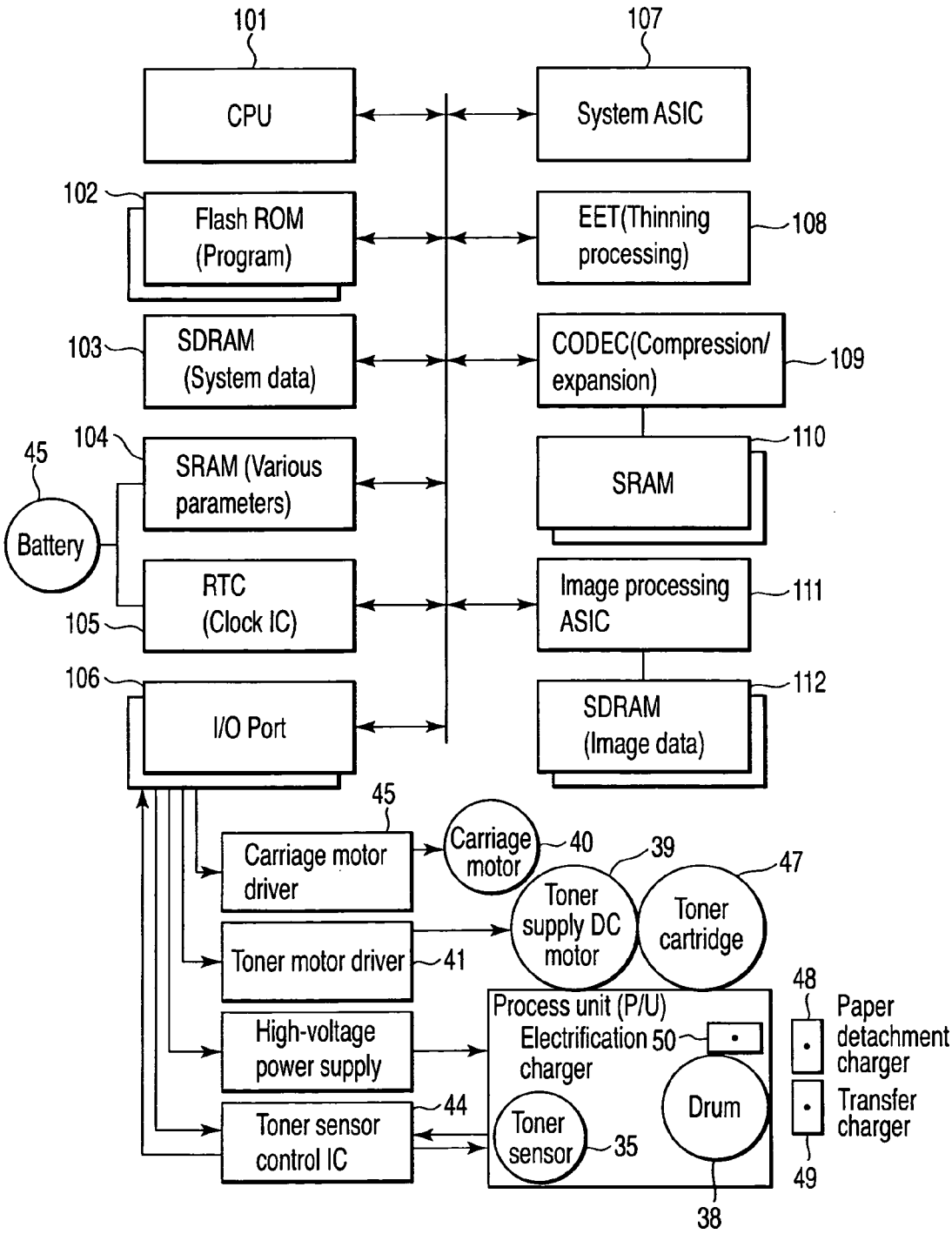
FIG. 3 is a block diagram showing a schematic structure of a control system of the image forming apparatus.

FIG. 3 is a block diagram showing a schematic structure of a control system of the image forming apparatus.

This image forming apparatus includes a flash ROM 102 which stores a control program including a program according to this embodiment, a CPU 101 which comprehensively controls this image forming apparatus in accordance with the control program, an SDRAM 103 which stores various kinds of system data, an SRAM 104 which stores various kinds of operation parameters, an RTC 105 which functions as a clock IC, an I/O port 106, and a system ASIC 107. Furthermore, the image forming apparatus includes an FET 108 for thinning processing, a CODEC 109 and an SRAM 110 for compression/expansion, and an ASIC 111 and an SDRAM 112 for image processing as an image processing portion.

The CPU controls a toner motor driver 41, a high-voltage power supply 43, a toner sensor IC 44 and a carriage motor driver 45 through the I/O port 106. The toner motor driver 41 drives a toner supply DC motor 39, the high-voltage power supply 43 supplies a high-voltage power to an electrification charger 50, a paper detachment charger 48 and a transfer charger 49, and the carriage motor driver 45 drives the carriage DC motor 40. The toner sensor IC 44 detects a toner quantity in the process unit 25 by using the toner sensor 35, and notifies the CPU 101 of a detection result (toner residual quantity detection signal) through the I/O port 106.

An operation concerning the embodiment of the toner residual quantity detection method according to the present invention will now be described with reference to flowcharts of FIGS. 4 to 8. Meanings of flags and counters used in the flowcharts will be first explained.

5sH flag F1: the CPU 101 turns on this flag when the toner continuously detects the shortage of the toner residual quantity in the process unit for five seconds during printing (here, "turning on the flag" means writing 1 in, e.g., a one-bit register).

Toner supply flag F2: the CPU 101 turns on this flag when the high-voltage power supply and the motor power supply are turned off, the toner residual quantity in the process unit is detected, and the shortage of the toner residual quantity is thereby detected.

Toner Low flag F3: the CPU 101 turns on this flag when it is determined that there is no toner (toner Low) in the toner cartridge during printing.

Toner empty flag F4: the CPU 101 turns on this flag when toner Low (no toner in the toner cartridge) is judged and then the specified number of paper sheets are printed.

Drum life flag F5: the CPU 101 turns on this flag when the life duration of the photosensitive drum is judged based on the number of printed paper sheets.

5sH counter C1: the number of printed paper sheets is indicated when the 5sH flag is on.

Toner Low counter C2: a content of this counter is increased by one when the shortage of the toner residual quantity in the process unit is detected immediately after supply of the toner.

It is to be noted that the values and numeric values of judgment conditions described in the following flowcharts and their explanation are not restricted, and they can be changed.

(1) Regular Printing Operation

Figure 4:
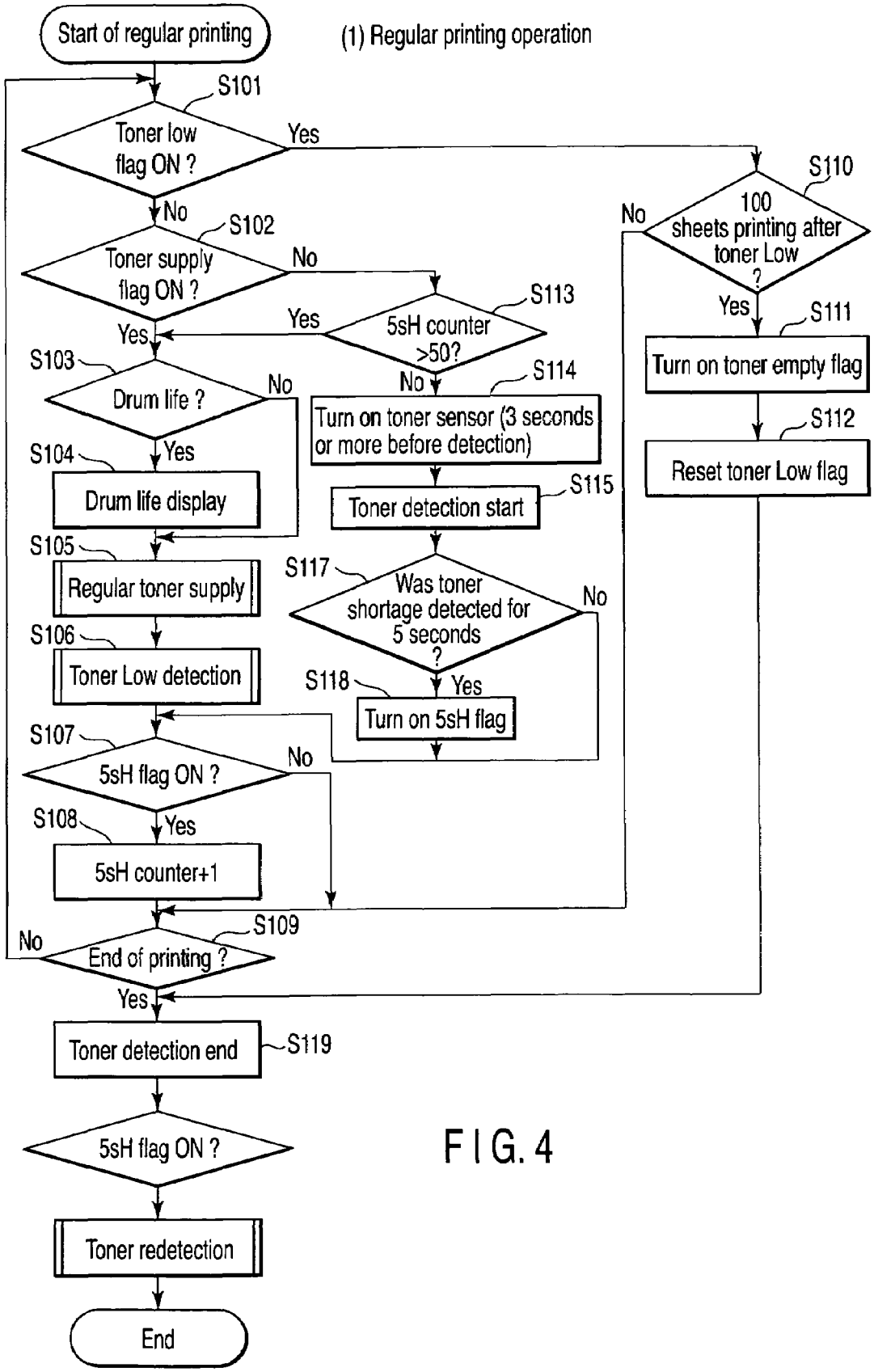
FIG. 4 is a flowchart showing a toner detection operation in regular printing.

FIG. 4 is a flowchart showing a toner detection operation in regular printing.

For example, when a copy button in the control panel is pressed, reading of an original image by the scanner portion 200 and regular printing of an image by the printer portion 300 are started. When the regular printing is started, the CPU 101 performs the following operation concerning toner quantity detection and toner supply while controlling the image reading and the printing operation. The control operation is mainly carried out by the CPU 101 in the following respective steps.

First, whether the toner Low flag F3 is ON is judged (S101). That is, a judgment is made upon whether there is no toner in the toner cartridge 47 in the previous printing operation. If the toner Low flag F3 is not ON, whether the toner supply flag F2 is ON is judged (S102). That is, for example, after the previous printing operation is terminated, the high-voltage power supply and the motor power supply are turned off in order to detect a toner residual quantity in the process unit, and whether the shortage of the toner residual quantity is detected is judged. If the toner supply flag F2 is ON (YES at S102), it is confirmed that the photosensitive drum 38 has not reached the end of its life (S103), and then regular toner supply is performed at a step S105.

(2) Regular Toner Supply

Figures 5, 6:
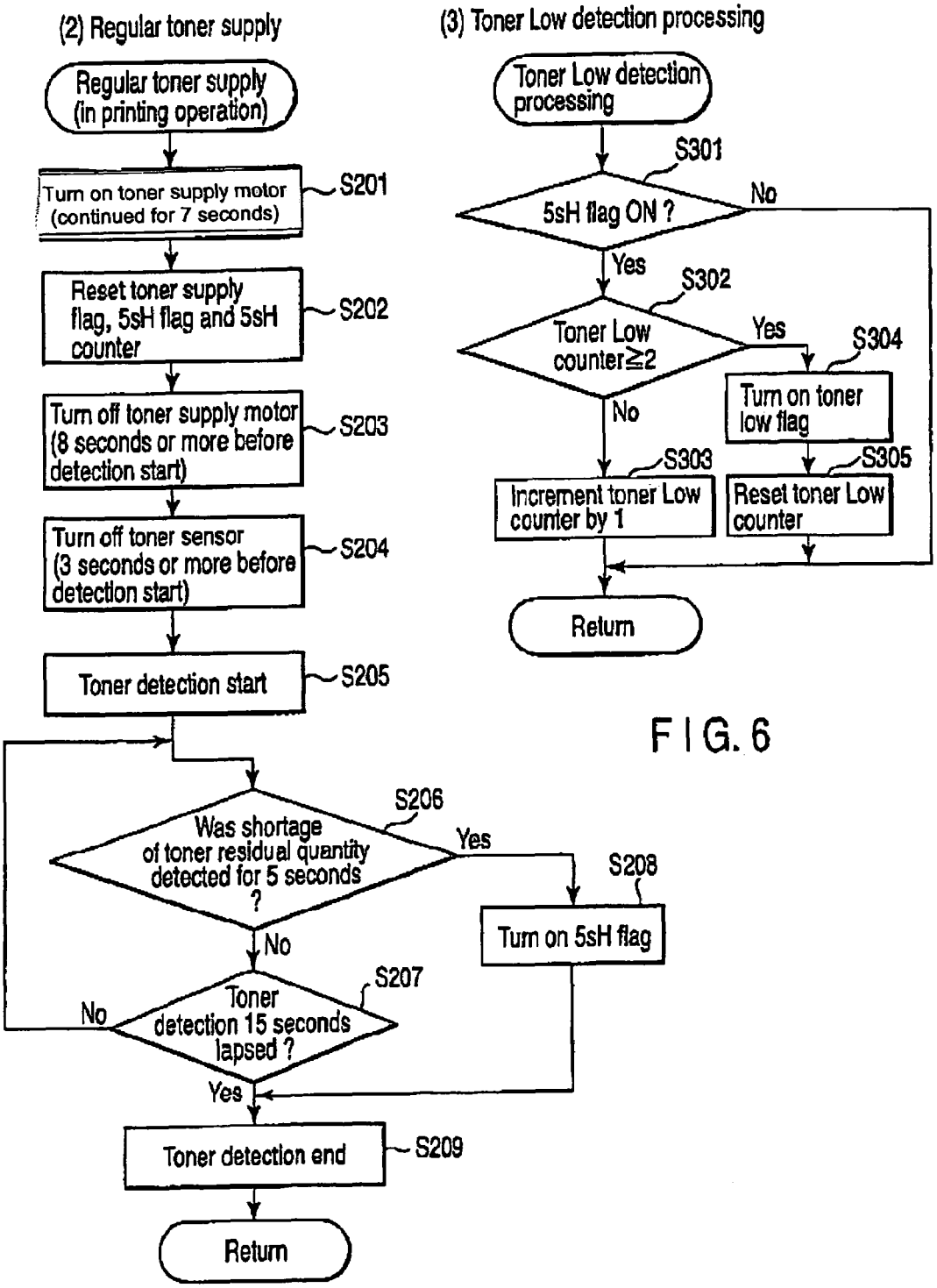
FIG. 5 is a flowchart showing a regular toner supply operation.
FIG. 6 is a flowchart showing toner Low detection processing.

FIG. 5 is a flowchart showing a regular toner supply operation. The regular toner supply must be carried out while rotating the mixer 34, and hence it is performed in the printing operation.

The toner supply motor 39 is set to ON for seven seconds (S201), the toner is supplied to the process unit from the toner cartridge, and the toner supply flag F2, the 5sH flag F1 and the 5sH counter C1 are reset (S202). Then, the toner supply motor is turned off (S203), the toner sensor 35 is turned on (vibrations by the piezoelectric element are started) (S204), and detection of a toner residual quantity immediately after toner supply is started (S205). Toner detection is performed for 15 seconds (S207). When an output from the toner sensor continuously indicates shortage of a residual quantity for five seconds (YES at S206), the 5sH flag F1 is turned on (S208), and toner detection is terminated (S209).

Again referring to FIG. 4, toner Low detection at a step S106 is executed after the regular toner supply at the step S105.

(3) Toner Low Detection Processing

FIG. 6 is a flowchart showing toner Low detection processing.

Like the step S208, when the 5sH flag F1 is ON by the toner residual quantity detection immediately after toner supply (YES at S301), the toner Low counter is incremented by 1 (S303) if the toner Low counter C2 is not 2 or above (NO at S302).

If the toner Low counter is already 2 or above (YES at S302), the toner Low flag F3 is turned on (S304), and the toner Low counter is reset (S305). Setting the toner Low flag F3 to ON means that the shortage of the toner residual quantity in the process unit 25 is not resolved even though the toner is supplied for three times and there is no toner in the cartridge 47.

Again referring to FIG. 4, when the 5sH flag F1 is ON like the step S107 (YES), the 5sH counter is incremented by 1 (S108), a judgment is made upon whether the current state is end of printing or it is in the continuous printing mode (S109). In case of end of printing, the control shifts to end processing. In case of the continuous printing mode, the control returns to the top step S101.

When the toner Low flag F3 is ON (YES at S101), it can be determined that there is not toner in the toner cartridge 47 as described above. Therefore, printing can be regularly performed up to the specified number of paper sheets (e.g., 100 sheets). When the specified number of paper sheets is exceeded, however, the toner empty flag F4 is turned on in order to protect the process unit 25 (S111), the toner Low flag F3 is reset, and printing is prohibited, i.e., stopped at the same time (S112).

When the toner supply flag F2 is OFF (NO at S102), a judgment is made upon whether the 5sH counter C1 indicates a predetermined number of sheets (e.g., 50 sheets) or above (S113). The control shifts to toner supply processing if it indicates the predetermined number of sheets or above (YES at S113), and the control shifts to toner detection processing if it indicates less than 50 sheets.

In the toner detection processing, a residual quantity detection signal of the toner sensor is observed during printing. When the shortage of the toner residual quantity is continuously detected for five seconds or more, the 5sH flag F1 is turned on (S114 to S118). The 5sH counter C1 is a counter indicative of the number of sheets continuously printed without performing toner redetection, which will be described later, when the 5sH flag F1 is ON. Like the step S113, when this counter indicates, e.g., 50 sheets or more, the toner residual quantity is in danger of being extremely lowered. Therefore, in order to protect the process unit 25, the toner supply operation is executed without performing the toner redetection. It is to be noted that although the productivity of printing is reduced if YES at the step S113, the continuous printing may be suspended and the control may shift to the toner redetection.

When printing is terminated (YES at S109), toner detection during printing is completed (S119). Here, in this embodiment, a judgment is made upon whether the 5sH flag F1 is ON like the step S120. If it is ON, the toner redetection at the step S121 is executed.

(4) Toner Redetection

Figure 7:
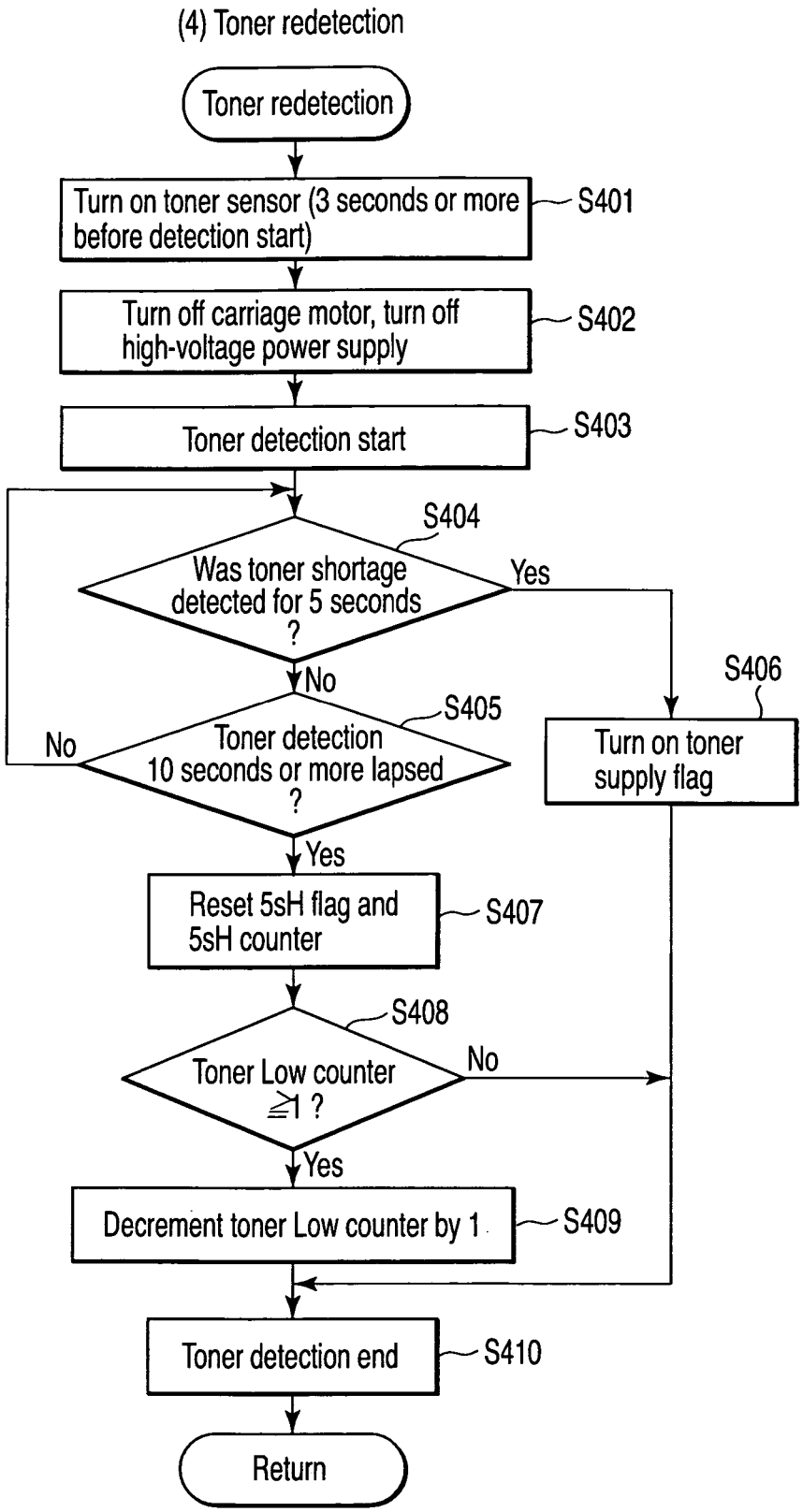
FIG. 7 is a flowchart showing a toner redetection operation.

FIG. 7 is a flowchart showing a toner redetection operation. This toner redetection is performed when the 5sH flag F1 is ON at the end of printing and in a later-described warming-up mode.

Vibrations by the piezoelectric element are first started by turning on the toner sensor (S401), the paper carriage motor 40 and the high-voltage power supply 43 are turned off (S402), and the detection of the toner residual quantity is started (S403). By turning off the carriage motor and the high-voltage power supply in this manner, the operation of a noise generation source is stopped, and the toner residual quantity is detected without mixing noises.

If the shortage of the toner residual quantity is continuously detected for five seconds when the toner residual quantity is detected for 10 seconds, the toner supply flag F2 is turned on (S404 to S406). If the shortage of the toner residual quantity is not continuously detected for five seconds (NO at S404), it is determined that the shortage of the toner residual quantity detected during printing is erroneous detection due to an influence of, e.g., noise, like the step S208, and the 5sH flag F1 and the 5sH counter C1 are reset (S407). At the same time, if the toner Low counter C2 indicates 1 or above (YES at S408), the value of the toner Low counter C2 is decremented by 1 (S409), and toner redetection is terminated (S409).

(5) Warming-Up

Warming-up is performed in the initial setting after the power supply of the apparatus is turned on or the system reset is canceled. Moreover, warming-up is carried out when detecting "open→close" of a door provided to the apparatus, e.g., a jam release cover (side cover) or a front cover which is opened when replacing the toner cartridge 47 or the process unit 25, or when canceling a power saving mode.

Figure 8:
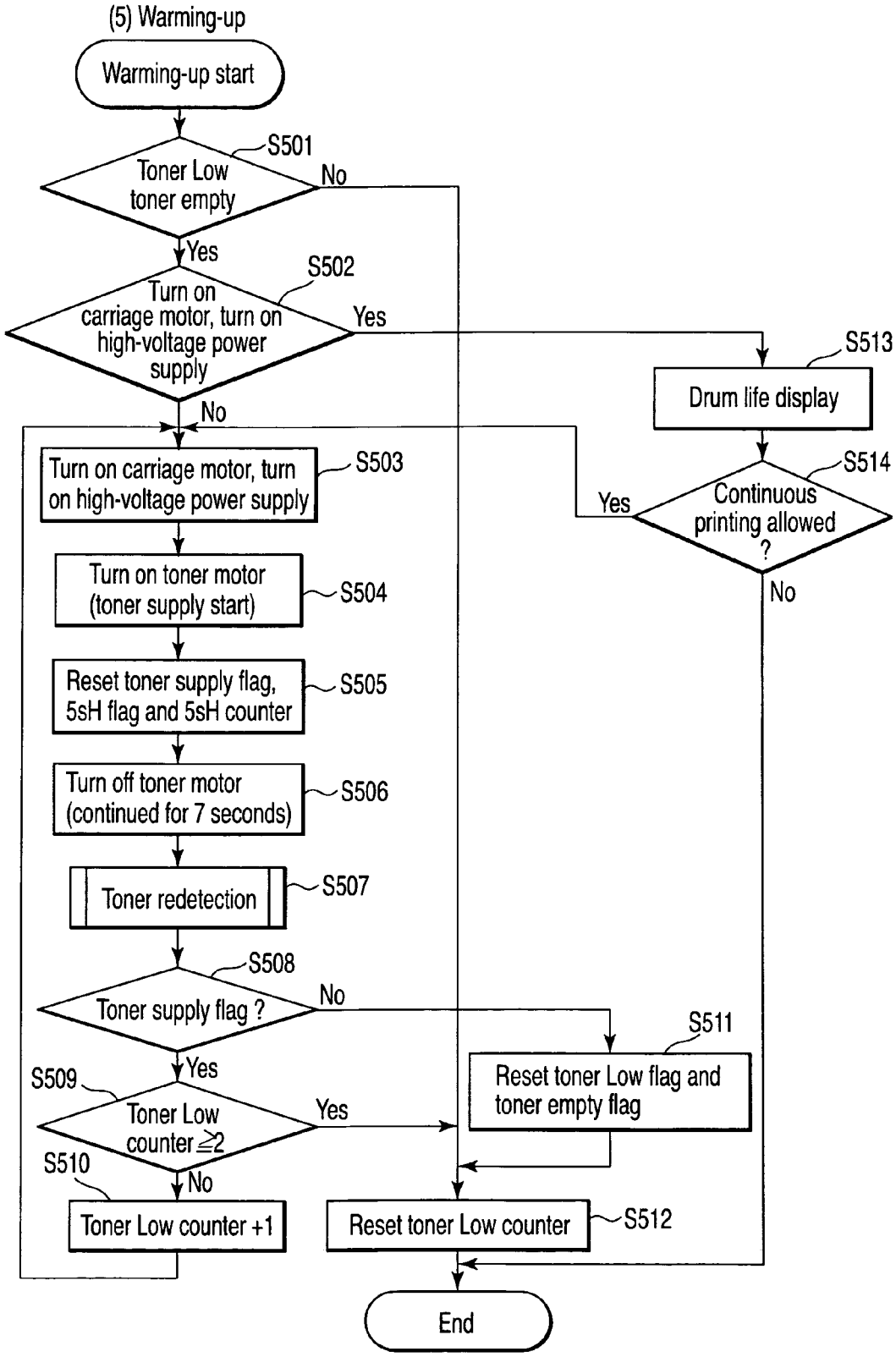
FIG. 8 is a flowchart showing a warming-up operation.

FIG. 8 is a flowchart showing a warming-up operation.

When starting warming-up, if the toner Low flag F3 or the toner empty flag F4 is ON (YES at S501), it is confirmed that the drum has not reached end of life (NO at S502), and then toner supply is started. That is, the carriage motor and the high-voltage power supply are turned on (S503), the toner motor is turned on (S504), and the toner supply flag F2, the 5sH flag F1 and the 5sH counter C1 are reset (S505). After rotating the toner supply motor for seven seconds, the toner motor is turned off (S506), and the above-described toner redetection (see FIG. 7) is executed (S507). That is, the operations of the carriage motor and the high-voltage power supply are stopped, and a toner residual quantity is detected without generating noise. Here, if the shortage of the toner residual quantity is detected, the toner supply flag F2 is turned on.

If the toner supply flag F2 is not ON (NO at S508), the toner Low flag F3 and the toner empty flag F4 are reset (S511), and the toner Low counter C2 is reset (S512).

In cases where the toner supply flag F2 is ON (YES at S508), if the toner Low counter C2 is not 2 or above (NO at S509), the toner Low counter C2 is incremented by 1 (S510), the control returns to the step S503, and toner supply is executed. If the toner Low counter C2 is 2 or above (YES at S509), i.e., if the shortage of the toner is not resolved even though toner supply is performed for three times, like the steps S504 to S506, the toner Low counter C2 is reset (S512) (the toner Low flag F3 and the toner empty flag F4 are not released). In this case, when the regular printing is then performed, printing of a predetermined number of sheets (e.g., 100 sheets) is possible, like the step S111 in FIG. 4, but printing of more sheets is prohibited until the toner cartridge is replaced.

When the toner Low flag or the toner empty flag is ON and an end of drum life is detected (YES at S502), which means that the photosensitive drum has reached the end of its life, printing may be prohibited in accordance with a specification of the photosensitive drum (S514), and toner supply may not be newly performed until the new process unit 25 (photosensitive drum) is set. It is to be noted that if the toner Low flag F3 is ON, printing may be allowed until toner empty is determined.

As described above, according to the present invention, even if a malfunction is generated in the toner residual quantity detection sensor due to physical vibrations or induction noise from the motor 5 or the high-voltage power supply during printing, excessive supply of the toner in the process unit can be avoided by executing toner redetection in the non-printing mode, thereby realizing a stable toner supply operation. Additionally, since execution by software control is possible, special circuit components or wiring thereof for vibration and noise countermeasures are not required.

The above has described the embodiment according to the present invention, but it does not restrict the apparatus and the method of the present invention, and various modifications can be carried out. Such modifications are included in the scope of the present invention. Further, an apparatus or a method configured by an appropriate combination of constituent elements, functions, features or method steps in each embodiment is also included in the scope of the present invention.

What is claimed is:

1. An image forming apparatus comprising:

a latent image formation portion which forms an electrostatic latent image on a photoreceptor based on an inputted image signal;

a development portion which causes a toner to adhere on the electrostatic latent image formed on the photoreceptor, to develop a toner image;

a transfer portion which transfers the toner image onto a paper sheet;

a carriage portion which carries the paper sheet;

a residual quantity detecting portion which detects a toner residual quantity of the development portion;

a first detecting portion which detects the toner residual quantity by using the residual quantity detecting portion during printing;

a second detecting portion which stops supply of power to the transfer portion when shortage of the toner residual quantity is detected by the first detecting portion, and again detects the toner residual quantity by using the residual quantity detecting portion; and a supply portion which supplies the toner to the development portion when the shortage of the toner residual quantity is detected by the second detecting portion.

2. The image forming apparatus according to claim 1, wherein redetection of the toner residual quantity by the second detecting portion is performed by stopping a carriage operation of the carriage portion.

3. The image forming apparatus according to claim 1, further comprising a detachment portion which detaches from the photoreceptor the paper sheet on which the image is transferred, wherein redetection of the toner residual quantity by the second detecting portion is performed by stopping supply of power to the detachment portion.

4. The image forming apparatus according to claim 1, wherein the second detecting portion redetects the toner residual quantity at the time of warming-up of the apparatus.

5. The image forming apparatus according to claim 4, wherein the warming-up is carried out immediately after a power supply of the apparatus is turned on.

6. The image forming apparatus according to claim 4, wherein the warming-up is carried out when one of doors provided to the apparatus is opened/closed.

7. The image forming apparatus according to claim 4, wherein the warming-up is performed when a power saving mode is canceled after the apparatus is set to the power saving mode.

8. The image forming apparatus according to claim 1, wherein the supply portion performs supply of the toner in a next printing operation.

9. The image forming apparatus according to claim 1, wherein, if the shortage of the toner residual quantity is detected by the first detecting portion during continuous printing in which images are continuously printed on a plurality of paper sheets, the supply portion performs toner supply after a predetermined number of paper sheets are printed.

10. The image forming apparatus according to claim 1, further comprising an image reading portion which optically reads an original image and provides an image signal corresponding to the original image to the latent image formation portion.

11. An image forming apparatus comprising:

a latent image formation portion which forms an electrostatic latent image on a photoreceptor based on an inputted image;

a development portion which causes a toner to adhere on the electrostatic latent image formed on the photoreceptor, to develop a toner image;

a transfer portion which transfers the toner image onto a paper sheet;

a carriage portion which carries the paper sheet;

a residual quantity detecting portion which detects a toner residual quantity of the development portion;

a first detecting portion which detects the toner residual quantity by using the residual quantity detecting portion during printing;

a second detecting portion which stops supply of power to the transfer portion and redetects the toner residual quantity by using the residual quantity detecting portion after completion of a current printing operation when shortage of the toner residual quantity is detected by the first detecting portion; and a supply portion which supplies the toner to the development portion when the shortage of the toner residual quantity is detected by the second detecting portion.

12. A toner supplying method for an image forming apparatus comprising:

forming an electrostatic latent image on a photoreceptor based on an inputted image signal;

causing a toner to adhere to the electrostatic latent image formed on the photoreceptor by using a developer and developing a toner image;

transferring the toner image onto a paper sheet by using a transfer portion;

detecting a toner residual quantity of the developer during printing;

stopping supply of power to the transfer portion when shortage of the toner residual quantity in the developer is detected, and again detecting the toner residual quantity; and supplying the toner to the development portion when the shortage of the toner residual quantity is detected as a result of redetection of the toner residual quantity.

13. The toner supplying method for an image forming apparatus according to claim 12, wherein redetection of the toner residual quantity is carried out by stopping a carriage operation of carrying a paper sheet.

14. The toner supplying method for an image forming apparatus according to claim 12, further comprising detaching from the photoreceptor the paper sheet on which the image is transferred by using a detachment portion, wherein redetection of the toner residual quantity is carried out by stopping supply of power to the detachment portion.

15. The toner supplying method for an image forming apparatus according to claim 12, wherein supply of the toner is performed in a next printing operation.

16. The toner supplying method for an image forming apparatus according to claim 12, wherein, when the shortage of the toner residual quantity is detected during continuous printing in which images are continuously printed on a plurality of paper sheets, the toner is supplied after printing a predetermined number of paper sheets.

* * * * *